US005728957A

United States Patent [19]

Valtchev

[11] Patent Number: 5,728,957

[45] Date of Patent: Mar. 17, 1998

[54] CLARINET LIGATURE AND MOUTHPIECE GRASPING RING

[76] Inventor: Konstantin L. Valtchev, 43 Cosmic Drive, North York, Ontario, Canada, M3B 3G11

[21] Appl. No.: 667,173

[22] Filed: Jun. 20, 1996

Related U.S. Application Data

[63] Continuation-in-part of Ser. No. 512,360, Aug. 8, 1995, Pat. No. 5,578,776, which is a continuation-in-part of Ser. No. 248,914, May 25, 1994, Pat. No. 5,440,962.

[51] Int. Cl.[6] ..... G10D 9/02

[52] U.S. Cl. ..... 84/383 R

[58] Field of Search ..... 84/383 R; D17/13, D17/383 A, 398

[56] References Cited

U.S. PATENT DOCUMENTS

| | | | |
|---|---|---|---|
| 2,138,500 | 11/1938 | Miessner | 84/723 |
| 2,292,584 | 8/1942 | Tafarella | 84/383 R |
| 2,527,988 | 10/1950 | Dillon | 84/383 R |
| 2,837,003 | 6/1958 | Collis | 84/383 R |
| 3,202,032 | 8/1965 | Strathmann | 84/383 R |
| 3,413,884 | 12/1968 | Sciacca | 84/383 R |
| 4,296,668 | 10/1981 | Lorenzini | 84/383 R |
| 4,345,503 | 8/1982 | Runyon | 84/383 R |
| 4,428,271 | 1/1984 | Winslow et al. | 84/383 R |
| 4,991,483 | 2/1991 | Petit | 84/383 R |
| 5,000,073 | 3/1991 | Hite | 84/383 R |
| 5,440,962 | 8/1995 | Valtchev | 84/383 R |
| 5,578,776 | 11/1996 | Valtchev | 84/383 R |

*Primary Examiner*—Michael L. Gellner
*Assistant Examiner*—Shih-yung Hsieh
*Attorney, Agent, or Firm*—Henderson & Sturm

[57] ABSTRACT

A clarinet ligature and grasping ring device (10) for use with a mouthpiece/reed assembly (100) wherein the device (10) includes a ligature unit (11) having a reed clamp member (20) and an elongated spring member (40) operatively connected to a mouthpiece member (101) having a reed member (103); and, a grasping ring unit (50) operatively connected to the mouthpiece member (101) and having a pair of apertured post members (71) which operatively engage spaced portions of the elongated spring member (40) for operatively and moveably connecting the ligature unit (11) to the grasping ring unit (12).

4 Claims, 1 Drawing Sheet

CLARINET LIGATURE AND MOUTHPIECE GRASPING RING

This is a continuation-in-part of U.S. patent application Ser. No. 08/512,360 filed on Aug. 8, 1995, and entitled "Clarinet Mouthpiece Grasping Ring", now U.S. Pat. No. 5,578,776, which issued on Nov. 26, 1996 which is a continuation-in-part of U.S. patent application Ser. No. 08/248,914 filed on May 25, 1994 and entitled "Clarinet Ligature and Grasping Ring" now U.S. Pat. No. 5,440,962, which issued on Aug. 15, 1995, the contents of which are incorporated herein by reference.

TECHNICAL FIELD

The present invention relates to the field of ligatures for musical instruments in general, and in particular to a new type of combined clarinet ligature and grasping ring.

BACKGROUND ART

As can be seen by reference to the following U.S. Pat. Nos. 5,000,073; 4,991,483; 3,202,032; and 2,837,003; the prior art is replete with a myriad and diverse mouthpiece and ligature constructions for musical reed instruments.

While all of the aforementioned prior art constructions are more than adequate for the basic purpose and function for which they have been specifically designed, these patented arrangements do no represent the ultimate design for this type of a device, and as will be explained further on in greater details there is ample room for improvement in this area of technology.

In addition none of the prior art devices contemplate the use of a grasping ring in combination with the ligature and the present invention specifically addresses that particular oversight.

As a consequence of the foregoing situation, there has existed a longstanding need among musicians who play reed instruments for a new type of clarinet ligature and grasping ring which will improve the performance of the musical instrument; and, the provision of such a construction is a stated objective of the present invention.

DISCLOSURE OF THE INVENTION

Briefly stated, the clarinet ligature and grasping ring device that forms the basis of the present invention comprises in general a grasping ring unit adapted to be secured to the mouthpiece portion of the clarinet mouthpiece assembly, and a ligature unit adapted to engage the clarinet reed and having a portion adapted to be engaged by the grasping ring.

In addition the ligature unit comprises a reed clamp member and a pair of spring support members associated with the grasping ring unit which are joined to one another in a surrounding relationship relative to the clarinet mouthpiece assembly by an elongated spring member which is releasably joined together on its opposite ends.

As will be explained in greater detail further on in the specification, the grasping ring unit permits easy removal of the mouthpiece from the barrel of the clarinet without disturbing the ligature. Furthermore the ligature unit possess the following advantages over the prior art. It permits easy vibration of the reed which makes the tone more focused and amplifies the sound. The reed is more sensitive to lip pressure, and sharpening or flattening of the tone can be achieved on a larger scale. The musician can change from the upper to lower register and vice versa very easily and, the reed can be changed very easily by displacing the reed clamp from the reed, pulling the old reed and replacing a new reed, followed by a release of the reed clamp.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
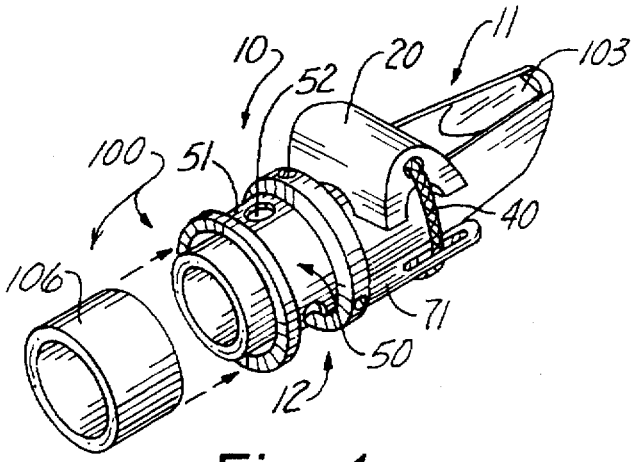
FIG. 1 is a perspective view of the clarinet ligature and grasping ring device that forms the basis of this invention employed on a clarinet mouthpiece assembly.

As can be seen by reference to the drawings, and in particular to FIG. 1, the clarinet ligature and grasping ring device that forms the basis of the present invention is designated generally by the reference numeral (10). The device (10) comprises in general a ligature unit (11) and a grasping ring unit (12) adapted to engage a clarinet mouthpiece reed assembly designated generally as (100). These units will now be described in ceriatim fashion.

Before embarking on a detailed description of the ligature unit (11) and grasping unit (12) it would first be advisable to briefly discuss the mouthpiece/reed assembly (100) which the aforementioned units were developed for use in conjunction with.

Figure 3:
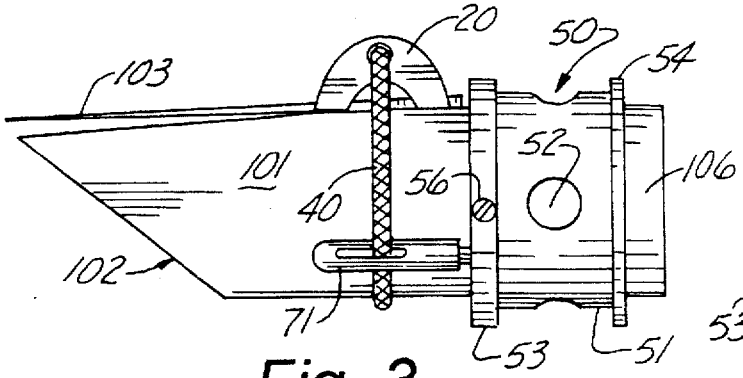
FIG. 3 is a side view of the device installed on the clarinet mouthpiece assembly.
Figure 4:
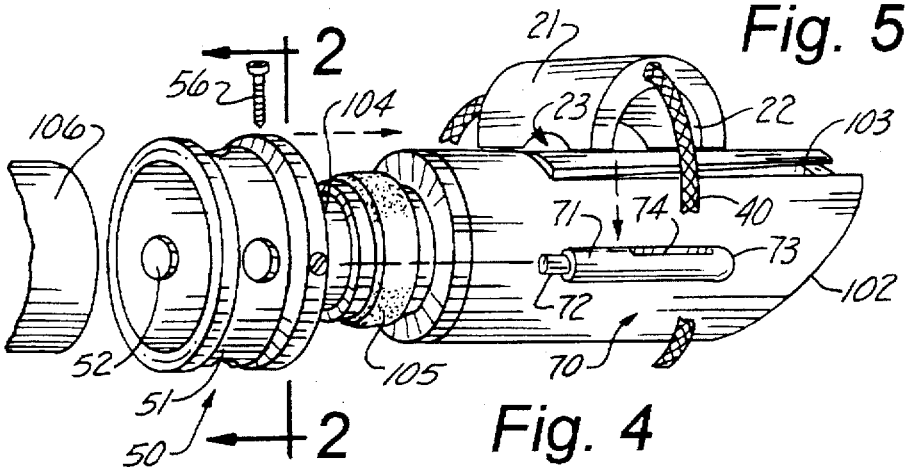
FIG. 4 is a partially exploded perspective view of the device.

As can best be appreciated by reference to FIGS. 1, 3 and 4, the mouthpiece/reed assembly (100) comprises a mouthpiece member (101) having a distal end (102) which is filled with a replaceable reed element (103); and a proximal end (104) which terminates in a reduced neck portion (105) which is dimensioned to slideably receive a conventional clarinet barrel member (106).

The ligature unit (11) comprises in general a reed clamp member (20) and an elongated spring member (40) operatively associated with the reed clamp member (20); wherein the spring member (40) is dimensioned to encircle the mouthpiece (101) and has opposite ends (not shown) which are designed to engage one another in a well recognized fashion.

Turning now to FIGS. 2 thru 5, it can be seen that the grasping ring unit (12) comprises a generally short hollow cylindrical grasping ring member (50) having a relatively short and generally truncated hollow cylindrical configuration; wherein, the grasping ring member (50) is provided with a peripheral recess (51) provided with a plurality of apertures (52) disposed at spaced locations around the peripheral recess; wherein the distal end (53) of the grasping ring member (50) defines a relatively thick lip portion and the proximal end (54) of the grasping ring member (50) defines a relatively thin lip portion.

Figure 5:
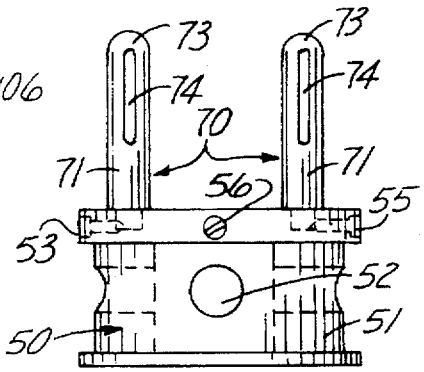
FIG. 5 is a bottom plan view of the grasping ring unit.

In addition, as shown in FIG. 5, the width of the recess (51) is dimensioned to accommodate the width of the users finger and the distal end (53) is thicker than the proximal end (54) of the grasping ring member (50) to both provide an enlarged bearing surface for the application of force to remove the mouthpiece member (101) from the clarinet.

At this juncture it should be noted that up to this point the portion of the ligature unit (11) and the grasping ring unit (12) that have been described conform exactly to their counterparts in the related applications mentioned supra.

Figure 2:
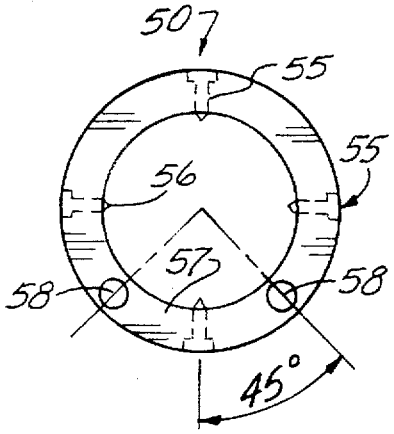
FIG. 2 is a front plan view of the grasping ring unit.

Turning now specifically to FIGS. 2 and 5 it can be seen that the periphery of the distal end (53) of the grasping ring member (50) is provided with a plurality of spaced discrete apertures (55) dimensioned to receive fastening elements (56) such as sharp tipped screws, or the like, for securing the grasping ring member (50) to the mouthpiece member (101).

In addition the lower portion of the face (57) of the distal end (53) of the grasping ring member (50) is provided with a pair of enlarged apertures (58) dimensioned to receive a portion of a pair of connecting members (70).

As can best be seen by reference to FIGS. 2 and 5, each of the connecting members (70) comprises an elongated post element (71) having an inboard end (72) dimensioned to be received in one of the enlarged apertures (58) and an outboard end (73) provided with an elongated slot (74) dimensioned to receive a portion of the spring member (40).

As shown in FIGS. 1, 3 and 4, the connecting member (70) forms the operative engagement between the ligature unit (11) and the grasping ring unit (12) by virtue of the threaded engagement of the spring member (40) of the ligature unit (11) through the slots (74) of the connecting members (70) of the grasping ring unit (12).

Furthermore the elongated slots (74) in the connecting members (70) allows the spring member (40) and the reed clamp member (20) to be laterally translated relative to both the mouthpiece member (101) and the reed (103) while still maintaining the operative engagement between the ligatire unit (11) and the grasping ring unit (12). In addition the discrete aperatures (55) and fastening elements (56) allow the grasping ring member (50) to be releasably secured to the mouthpiece member (101) in a well recognized fashion.

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A clarinet ligature and grasping ring device for use with a mouthpiece/reed assembly which includes a mouthpiece member having a replaceable reed element wherein the device comprises a ligature unit including a reed clamp member and an elongated spring member operatively associated with the reed clamp member for securing the ligature unit to said mouthpiece member a grasping ring unit including a hollow cylindrical grasping ring member having a proximal end and a distal end, and dimensioned to surround said mouthpiece member; and, connecting means operatively associated with the distal end of the grasping ring member and portions of the spring member for operatively connecting the ligature unit to the grasping ring unit for relative movement with respect to one another; wherein, said connecting means comprise a pair of post members having one end operatively connected to the distal end of the grasping ring member and the other end operatively engaged with spaced locations on said elongated spring member.

2. The device as in claim 1; wherein, the grasping ring member is further provided with an intermediate peripheral recess defining a relatively thick distal end and a proximal end; and, means for releasably connecting the distal end to said mouthpiece member.

3. The device as in claim 2; wherein, said means for releasably connecting the distal end of the grasping ring member to the mouthpiece member comprises a plurality of discrete apertures formed on the periphery of the distal end of the grasping ring member; and, a plurality of discrete fastening elements dimensioned to be received in said discrete apertures.

4. The device as in claim 1; wherein, the intermediate portions of said pair of post members are provided with elongated slots which are dimensioned to receive the spaced locations on said elongated spring member.

* * * * *